United States Patent [19]

Del Rosó

[11] Patent Number: 4,548,149

[45] Date of Patent: Oct. 22, 1985

[54] RUDDER FOR AQUATIC CRAFT

[76] Inventor: Americo Del Rosó, 21858 River Oaks Dr., Rocky River, Ohio 44116

[21] Appl. No.: 548,655

[22] Filed: Nov. 4, 1983

[51] Int. Cl.[4] ..... B63H 25/06

[52] U.S. Cl. ..... 114/162

[58] Field of Search ..... 114/144 R, 149, 152, 114/162–172; 440/13–15, 51

[56] References Cited

U.S. PATENT DOCUMENTS

| | | | |
|---|---|---|---|
| 594,068 | 11/1897 | Dobson | 114/162 |
| 923,283 | 6/1909 | Loomer | 440/14 |
| 2,555,886 | 6/1951 | Jones | 440/15 |
| 2,910,708 | 11/1959 | Albright | 114/162 |
| 2,987,030 | 6/1961 | De Jean | 440/15 |
| 3,139,061 | 6/1964 | Johnston | 440/15 |
| 3,670,685 | 6/1972 | Milessa | 114/162 |
| 3,855,957 | 12/1974 | Gross | 440/15 |

FOREIGN PATENT DOCUMENTS

| | | | |
|---|---|---|---|
| 1295928 | 5/1962 | France | 114/162 |
| 2395888 | 3/1979 | France | 114/162 |
| 2436073 | 5/1980 | France | 114/162 |
| 959894 | 6/1964 | United Kingdom | 440/14 |
| 2091664 | 8/1982 | United Kingdom | 114/162 |

*Primary Examiner*—Trygve M. Blix
*Assistant Examiner*—Stephen P. Avila
*Attorney, Agent, or Firm*—Woodling, Krost, Rust & Hochberg

[57] ABSTRACT

A watercraft rudder assembly including a rudder blade having a forward planar rigid portion and a rearward planar flexible fin portion, such fin portion having a resiliency rendering it planar at low craft speeds and bendable to opposite sides of the rigid rudder portion at high craft speeds so that low speed turning ability of the craft is substantially enhanced.

2 Claims, 13 Drawing Figures

RUDDER FOR AQUATIC CRAFT

BACKGROUND OF THE INVENTION

This invention relates to a rudder for aquatic craft and more particularly to such a rudder having a forward planar rigid portion and a rearward planar flexible portion.

Conventional boat rudders are of relatively large planar area to provide quick and positive steering response. However, such large rudder planar area can be a hazard with smaller craft going at high speeds as instant steering response or oversteering could result in boat turnover. On the other hand instant steering response and quick maneuverability are highly desirable at low speeds in confined areas such as in marinas and restricted waterways where low speeds are mandatory.

Therefore, it is an object of the invention to provide a watercraft rudder effecting adequate steering response at high watercraft speeds and instant steering response and quick maneuverability at low watercraft speeds.

A further object of the invention is to provide a watercraft rudder of the above type having a forward planar rigid portion and a rearward planar flexible fin portion bendable to opposite sides of the rigid portion at high speed yet relatively rigid at low speeds to effect enhanced low speed turning ability.

A further object of the invention is to provide a watercraft rudder of the above type that is simple in construction, inexpensive to manufacture, and highly effective in operation.

BRIEF DESCRIPTION OF THE INVENTION

Briefly the foregoing objects are accomplished by the provision of a vertically pivoted rudder assembly for aquatic craft including, a main planar rigid rudder operationally mounted on the craft to steer the same, such rigid rudder having a resilient planar fin secured to its trailing edge to form a rearward planar extension of the rudder. The fin has a resiliency rendering it planar at low craft speeds and bendable to opposite sides of the rigid rudder at high craft speeds so that low speed turning ability of the craft is substantially enchanced. In the preferred form, the fin is formed of rubber of preselected resiliency. In one modification, the rigid rudder has a slot formed in its trailing edge and the fin is secured in said slot.

In another structural modification, the rudder assembly is formed of a resilient planar material which extends through a vertical slot in an associated rudder post, plus two vertically elongated coacting matched rigid planar half shell portions fastened to each other around the post with the post and resilient planar material being secured between the half shell portions. The coacting half shell portion of the rudder constitutes the rigid planar portion of the rudder and the rearward remainder of the resilient planar material forms the flexible fin.

In another modification, the rigid and flexible portions are formed of semi-resilient material with the rigid portion being substantially thick to render it rigid and the flexible portion being substantially thin to render it flexible.

Other objects and advantages of the invention will be apparent from the following description taken in conjunction with the drawings wherein:

BRIEF DESCRIPTION OF THE DRAWINGS

In the drawings, like numbers and letters are used to identify like and similar parts throughout the several views.

DESCRIPTION OF THE PREFERRED EMBODIMENTS

Figure 1:
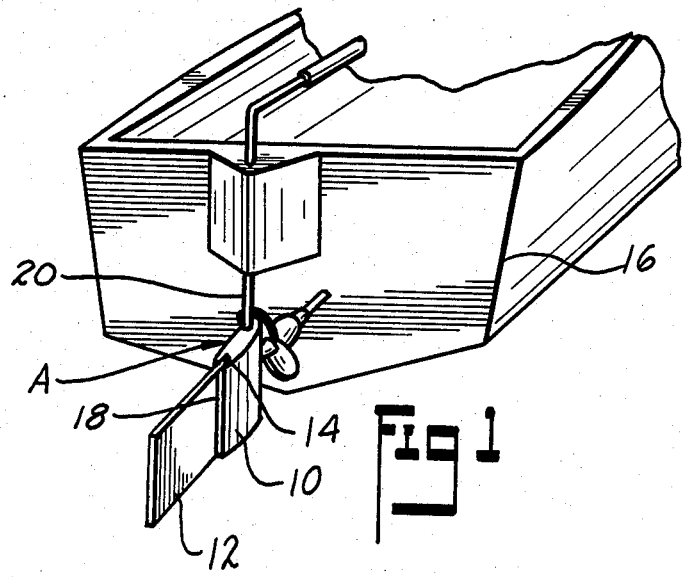
FIG. 1 is a perspective view of the aft end of a boat having a rudder assembly of the invention mounted thereon.
Figure 2:
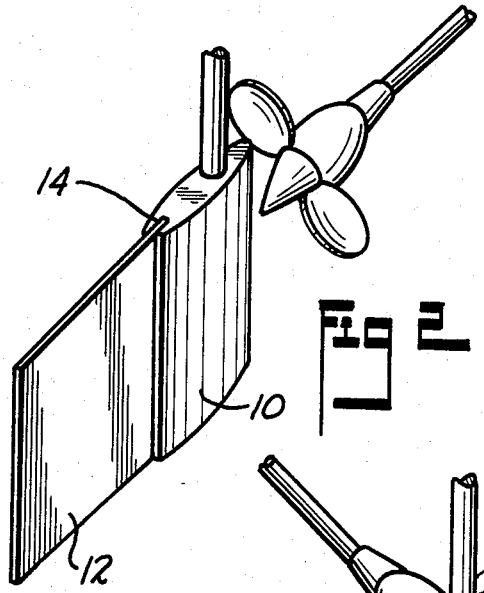
FIG. 2 is an enlarged view of the propeller and rudder assembly shown in FIG. 1, and showing the rudder in position to steer the boat directly forward.
Figure 3:
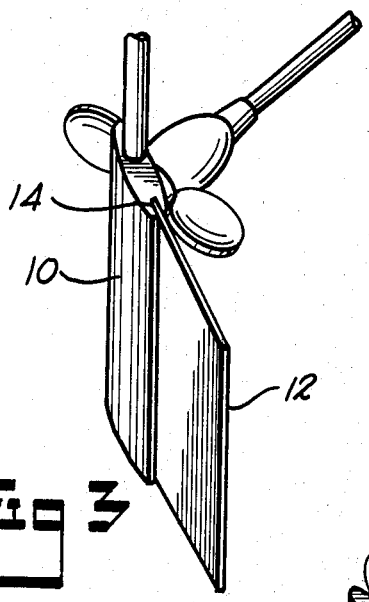
FIG. 3 is a view similar to FIG. 2 but showing the rudder with its fin in position to turn the boat at low speeds to starboard.
Figure 4:
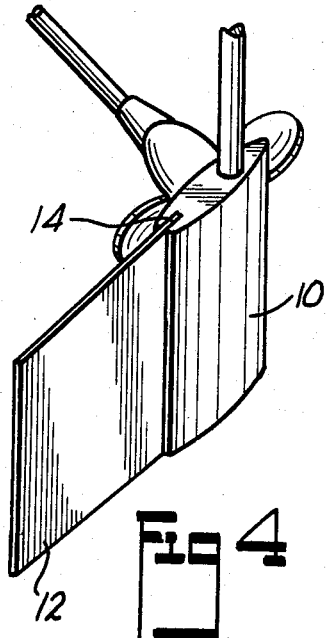
FIG. 4 is a view similar to FIG. 2 but showing the rudder with its fin in position to turn the boat at low speeds to port.
Figure 5:
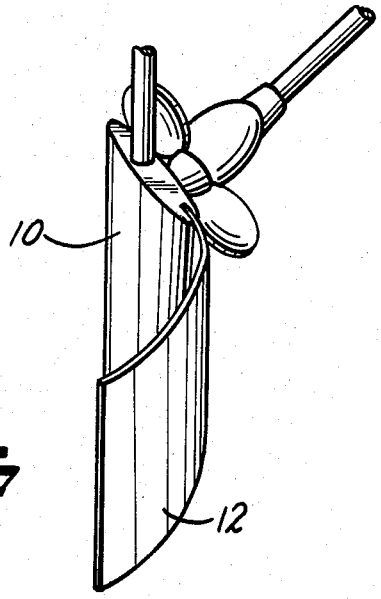
FIG. 5 is a view similar to FIG. 3, but showing the rudder with its fin in high speed position to turn the boat to starboard.

Referring first to FIGS. 1 and 5, there is shown a rudder assembly A of the invention which includes, in its basic form, a forward main rigid planar rudder portion 10 and a rearward planar flexible fin or fin portion 12. The flexible portion 12 may be formed of any suitable resilient material such as, for example, rubber of preselected resiliency. The fin 12 is secured in the slot 14 of the rigid portion 10 by any suitable means.

Figure 8:
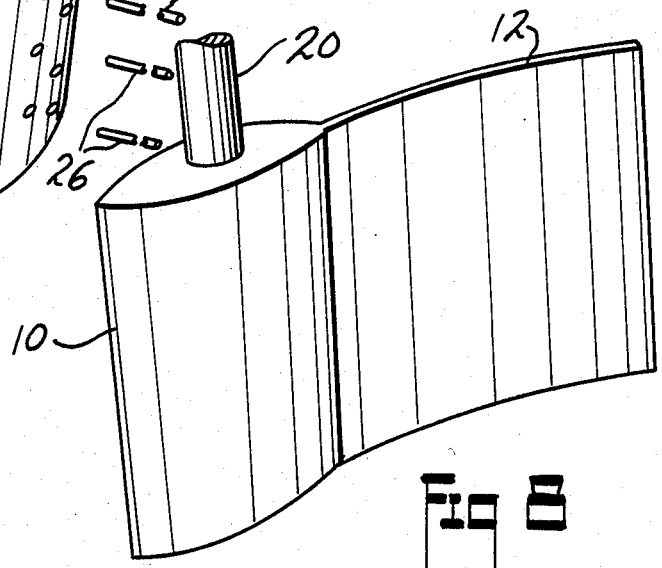
FIG. 8 is a perspective view of a further modification of the invention.
Figure 9:
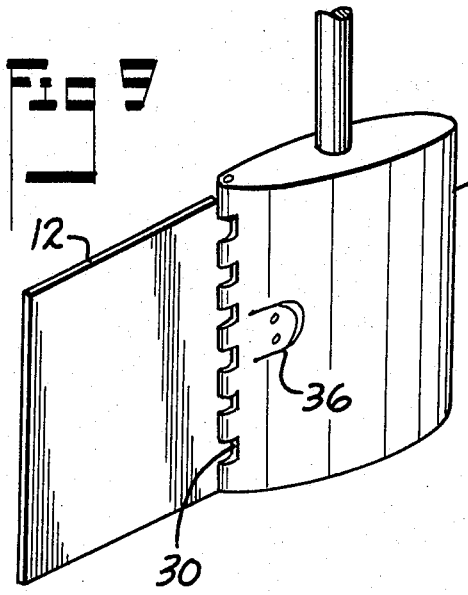
FIG. 9 is a perspective view of a further modification of the invention.

In a modification of the invention, the rigid and flexible portions 10 and 12 may both be formed of semi-resilient material (FIG. 8) with the rigid portion 10 being substantially thick to render it rigid and the flexible portion 12 being substantially thin to render it flexible.

As best shown in FIG. 1, the invention provides a vertically pivoted rudder assembly A for an aquatic craft 16 including the main planar rigid rudder 10 operationally mounted on the associated rudder post 20 of the craft 16 to steer the same, such rigid rudder 10 having the resilient planar fin 12 secured to its trailing edge 14 to form a rearward planar extension of the rigid rudder 10. The fin 12 has a resiliency rendering it planar at low craft speeds and bendable to opposite sides of the rigid rudder 10 at high craft speeds so that low speed turning ability of the craft 16 is substantially enhanced. The fin 12 may be of a different planar area than the rigid rudder 10.

Figure 6:
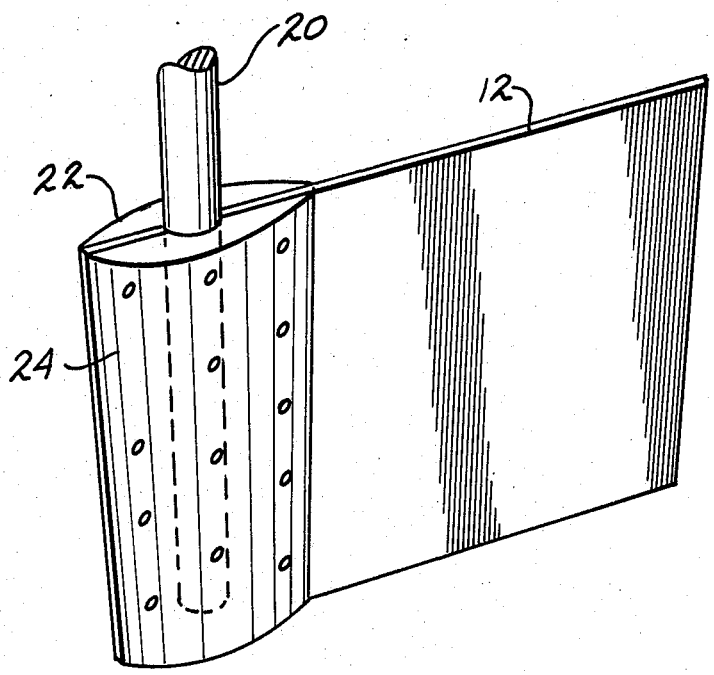
FIG. 6 is a perspective view of a modification of the invention.
Figure 7:
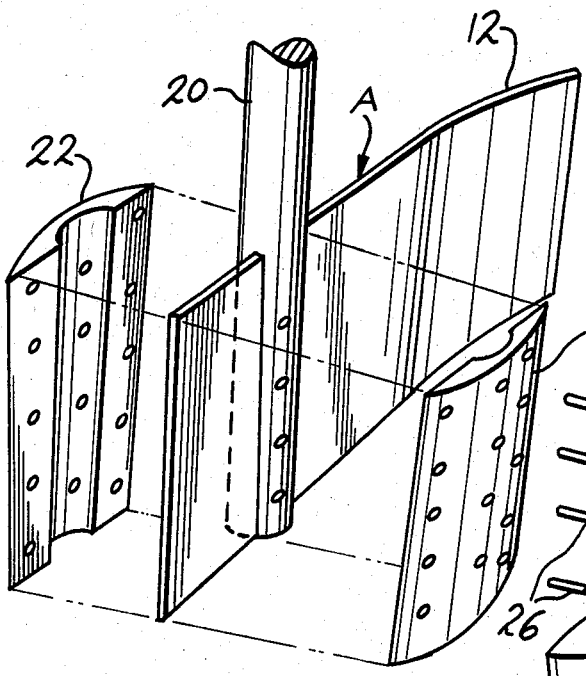
FIG. 7 is an exploded perspective view of the structure shown in FIG. 6, but showing the parts thereof in position prior to assembly.

Referring to FIGS. 6 and 7, there is shown a further modification including two vertically elongated coacting matched half shell portions 22, 24 fastened to each other (by the bolts 26) around the post 20 with the post and rudder assembly A being secured between such half shell portions. This provides a simplified structure to apply the rudder of the invention to an existing rudder post.

Thus, the invention provides a very simplified rudder that is highly effective in turning the boat at high speeds with no oversteering, and unusually effective at turning the boat at low speeds by utilizing the entire area of both the rigid portion 10 of the rudder and the fin portion 12, thereby providing very safe boat steering at all speeds. In effect, a double size rudder is provided at low speeds.

Figure 10:
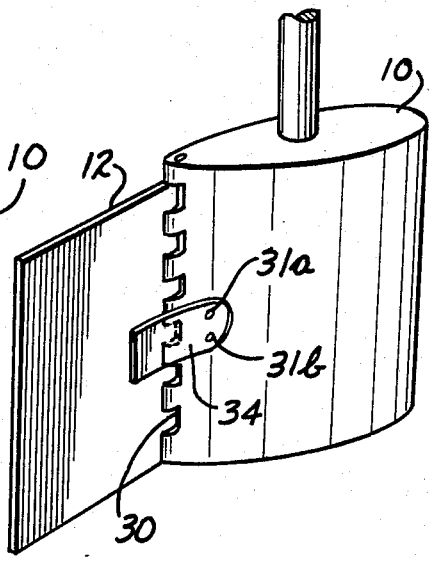
FIG. 10 is a view similar to FIG. 9, but showing the leaf springs added.
Figure 11:
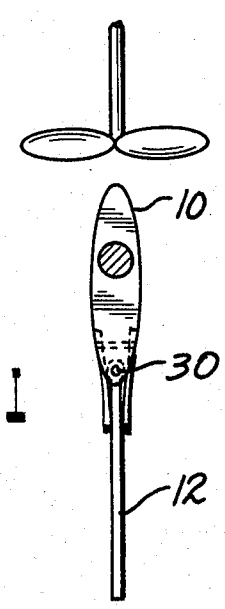
FIG. 11 is a view taken along the line 11—11 of FIG. 10.
Figure 12:
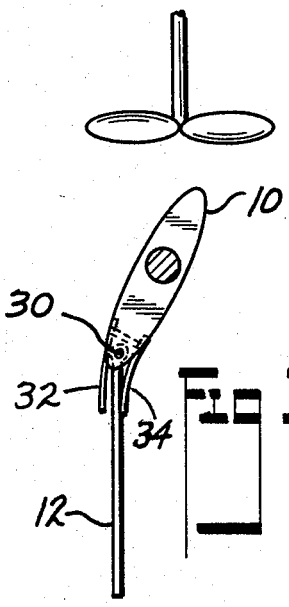
FIG. 12 is a view similar to FIG. 11, but showing the rudder in position to turn the boat to port.
Figure 13:
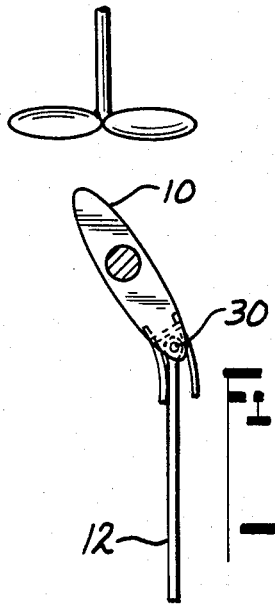
FIG. 13 is a view similar to FIG. 11, but showing the rudder in position to turn the boat to starboard.

In the modification shown in FIGS. 9–14, the flexible fin 12 is hingedly secured to the rigid rudder 10 by a vertical hinge 30 (FIG. 10). Also, the rigid rudder 10 has secured thereto, by bolts 31*a*, 31*b*, a pair of spaced leaf springs 32, 34, such springs having their free end portions straddling the fin 12 as best shown in FIGS. 11, 12 and 13. The springs 32, 34 are secured in respective recesses in the rudder 10 such as, for example, the recess 36 (FIG. 9) which receives the spring 34 as shown in FIG. 10. This structure provides a preselected additional amount of rigidity to the flexible fin 12 as may be required in certain aquatic craft.

The terms and expressions which have been employed are used as terms of description, and not of limitation, and there is no intention, in the use of such terms and expressions, of excluding any equivalents of the features shown and described or portions thereof, but it is recognized that various modifications are possible within the scope of the invention claimed.

What is claimed is:

1. A rudder assembly for speedboat type aquatic craft including a main rigid rudder comprising two elongated coacting matched shell portions together forming a bore, a rudder post rotatable about a vertical axis and extending into the bore, a coacting resilient planar fin, the fin extending through the post and being sandwiched between the shell portions, a plurality of bolts extending transversely through the shell portions, the post and the fin to rigidly secure the assembly together, said fin having a preselected resiliency rendering it planar at low craft speeds and bendable to opposite sides of the rigid rudder at a preselected high craft speed and higher so that oversteering is avoided at high craft speeds and low speed turning ability of the craft is substantially enhanced.

2. An aquatic craft rudder for speedboat type aquatic craft having a forward rigid portion and a coacting rearward fin portion, said rigid portion and said fin portion being joined by a vertical hinge, said rigid portion having secured thereto by bolts a pair of spaced leaf springs of predetermined resiliency that straddle said fin portion, whereby when the craft is underway both of said leaf springs contact the fin portion when the rudder is disposed in straight-forward position, and whereby one of the leaf springs is always in contact with the fin portion when the rudder is turned in one direction, and the other leaf spring is always in contact with the fin portion when the rudder is turned in the other direction to provide an additional amount of rigidity to the fin portion on rudder turning said springs rendering said rigid portion and said fin portion planar at low craft speeds and allowing said fin portion to move against said springs to opposite sides of said rigid portion at preselected high craft speeds and higher so that oversteering is avoided at high craft speeds and low speed turning ability of the craft is substantially enhanced.

* * * * *

UNITED STATES PATENT AND TRADEMARK OFFICE

CERTIFICATE OF CORRECTION

PATENT NO. :4,548,149

DATED :October 22, 1985

INVENTOR(S) :Americo Del Raso

It is certified that error appears in the above-identified patent and that said Letters Patent is hereby corrected as shown below:

On the title page inventor should read

-- (76) Inventor: Americo Del Raso --.

Signed and Sealed this

*Eighteenth* Day of *February 1986*

[SEAL]

*Attest:*

DONALD J. QUIGG

*Attesting Officer*

*Commissioner of Patents and Trademarks*